US010827817B2

(12) United States Patent
Chevalier

(10) Patent No.: US 10,827,817 B2
(45) Date of Patent: Nov. 10, 2020

(54) APPLICATOR DEVICE FOR A COSMETIC PRODUCT

(71) Applicant: LVMH Recherche, Saint Jean de Braye (FR)

(72) Inventor: Marc Chevalier, Franconville (FR)

(73) Assignee: LVMH RECHERCHE, Saint Jean de Braye (FR)

( * ) Notice: Subject to any disclaimer, the term of this patent is extended or adjusted under 35 U.S.C. 154(b) by 20 days.

(21) Appl. No.: 16/313,257

(22) PCT Filed: Jun. 23, 2017

(86) PCT No.: PCT/FR2017/051687
§ 371 (c)(1),
(2) Date: Dec. 26, 2018

(87) PCT Pub. No.: WO2018/002494
PCT Pub. Date: Jan. 4, 2018

(65) Prior Publication Data

US 2019/0150590 A1 May 23, 2019

(30) Foreign Application Priority Data

Jun. 29, 2016 (FR) ..... 16 56101

(51) Int. Cl.
*A45D 34/04* (2006.01)
*A45D 40/26* (2006.01)

(52) U.S. Cl.
CPC ..... *A45D 34/045* (2013.01); *A45D 34/04* (2013.01); *A45D 40/265* (2013.01); *A45D 2200/1072* (2013.01)

(58) Field of Classification Search
CPC ..... A45D 34/00; A45D 34/02; A45D 34/04; A45D 34/041; A45D 34/042; A45D 34/043; A45D 34/045; A45D 34/046; A45D 30/262; A45D 40/265; A45D 40/267; A45D 2200/1072; A45D 2200/10
See application file for complete search history.

(56) References Cited

U.S. PATENT DOCUMENTS 1,672,726 A * 6/1928 Moorhead ..... F16N 7/12 15/104.001
2,298,534 A * 10/1942 Kaye ..... A45D 40/00 401/128
3,147,511 A * 9/1964 Pittoni ..... A45D 40/265 401/128
4,313,686 A * 2/1982 Proffer ..... B65D 51/32 401/127
6,033,143 A 3/2000 Gueret

FOREIGN PATENT DOCUMENTS

EP 0 752 222 A1 1/1997
FR 3 026 619 A1 4/2016

OTHER PUBLICATIONS

International Search Report Application No. PCT/FR2017/051687; Reported on Sep. 29, 2017.

* cited by examiner

*Primary Examiner* — David J Walczak
(74) *Attorney, Agent, or Firm* — Miller, Matthias & Hull LLP

(57) ABSTRACT

Applicator device for a cosmetic product, comprising a flexible applicator head comprising a convergent body and a terminal portion. The convergent body is shorter than the terminal portion, and the terminal portion has a uniform cross-section.

11 Claims, 1 Drawing Sheet

APPLICATOR DEVICE FOR A COSMETIC PRODUCT

CROSS-REFERENCE TO RELATED APPLICATION

This Application is a 35 USC § 371 US National Stage filing of International Application No. PCT/FR2017/051687 filed on Jun. 23, 2017, and claims priority under the Paris Convention to French Patent Application No. 16 56101 filed on Jun. 29, 2016.

FIELD OF THE DISCLOSURE

The present invention relates to applicator devices for cosmetic products.

OF THE DISCLOSURE

More particularly, the invention relates to an applicator device for a cosmetic product, comprising a support suitable for being held in a user's hand and an applicator head carried by the support, the applicator head being flexible and suitable for applying the cosmetic product onto part of the body of a user, said applicator head comprising a convergent body and an applicator body, the convergent body extending for a first length while converging from a first end fixed to the support to a second end, and the applicator body extending the second end of the convergent body for a second length extending from the second end of the convergent body to a distal end, the applicator body having a uniform cross-section from the second end of the convergent body to the distal end of said applicator body, and the second length (L2) being greater than the first length.

U.S. Pat. No. 6,033,143 describes an example of an applicator device of this type.

SUMMARY OF THE DISCLOSURE

The present invention is intended to improve the convenience, application accuracy, and ease of application of applicator devices of the above type.

To this end, according to the invention, an applicator device of the kind in question is characterized in that the applicator body (11) has a width (D2) comprised between 0.5 mm and 5 mm, advantageously between 0.5 mm and 1 mm.

With these features, product application is particularly accurate. The small width of the applicator body makes it particularly flexible, which makes application to the eyelid very easy. In addition, due to the fact that the convergent body is shorter than the applicator body of the applicator head, application is performed primarily by the applicator body, without the user having to precisely judge the application force he or she exerts on the support. As the applicator body is of uniform cross-section, application occurs along a precise line of constant width. When the cosmetic product is an eyeliner, the applicator body forms a tail which, during application, can be guided by the fringe of the wearer's eyelashes to facilitate application.

In various embodiments of the device according to the invention, one or more of the following arrangements may possibly be used:

- the second length is greater than 1.2 times the first length;
- the second length is less than 2.4 times the first length;
- the first length is comprised between 2 and 8 mm, in particular about 5 mm;

- the cross-section of the applicator body has a circumscribed diameter comprised between 0.5 mm and 5 mm, advantageously between 0.5 mm and 1 mm;
- the applicator head is made of a thermoplastic elastomer material;
- the applicator device further comprises a reservoir suitable for containing a liquid cosmetic product (more or less viscous formulation that is an actual liquid, viscous, creamy to pasty, for example of a viscosity similar to a mascara or eyeliner formulation), the support having a rod suitable for insertion into said reservoir in order to dip said applicator head into the cosmetic product;
- the reservoir contains an eyeliner, constituting said liquid cosmetic product.

The invention also relates to a use of an applicator device as defined above to apply a cosmetic product, in particular an eyeliner.

Other features and advantages of the invention will be apparent from the following description of one of its embodiments, given as a non-limiting example, with reference to the accompanying drawings.

BRIEF DESCRIPTION OF THE DRAWINGS

In the drawings.

In the different figures, the same references denote identical or similar elements.

DETAILED DESCRIPTION OF THE DISCLOSURE

Figure 1:
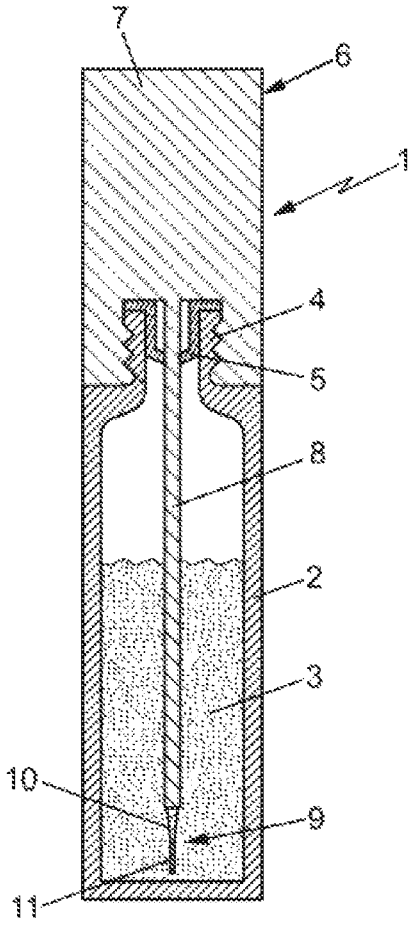
FIG. 1 is a longitudinal sectional view of an applicator device for a cosmetic product according to a first embodiment of the invention, in the storage position.
Figure 2:
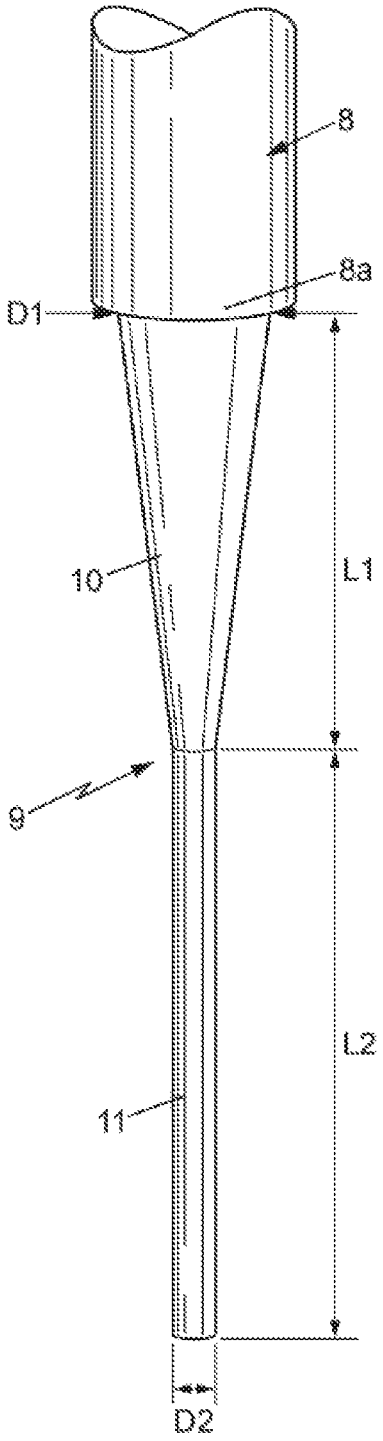
FIG. 2 is a detailed view of the applicator head of the applicator device of FIG. 1.

FIG. 1 shows an applicator device 1 for a more or less viscous liquid cosmetic product, in particular an eyeliner.

This applicator device 1 comprises a reservoir 2 made of plastic or some other material, which contains the cosmetic product 3. The liquid cosmetic product may be more or less viscous, of a formulation that is an actual liquid, viscous, creamy to pasty, for example of a viscosity similar to a mascara or eyeliner formulation.

The reservoir may comprise for example a neck 4 possibly provided with an internal wiper 5, as is known per se.

The applicator device 1 may further comprise an applicator 6, comprising a support 7, 8 of plastic or some other material, bearing a flexible applicator head 9 (more flexible than the support 7, 8).

The support 7, 8 may comprise a gripping member 7 suitable for being held by a user, and a rod 8 which may or may not be rectilinear which passes through the neck 4 and the wiper 5. The gripping member 7 may possibly be a cap suitable for sealing the neck 4, for example by screwing or the like.

The rod 8 may have a width comprised between 3 and 8 mm; for example, the rod 3 is cylindrical with a circular cross-section, of a diameter comprised in particular between 3 and 3 mm.

When the support 7, 8 comprises a rod 8, the applicator head 9 may extend longitudinally along the axis of the rod 8, from the free end of the rod 8. The applicator head 9 could also form an angle with the rod 8 that is different than 180 degrees.

The applicator head 9 comprises a convergent body 10 and an applicator body 11.

The convergent body 10 extends (along the longitudinal axis of the rod 8 in the example shown) for a first length L1 while converging from a first end fixed to the support 7, 8 (for example to the free end of the rod 8) to a second end.

The convergent body 10 may be of any desired cross-section, converging from a width D1 at the free end of the rod 3 to a width D2 at the free end of the convergent body 10. When it has a circular cross-section, the body 10 may converge from a diameter D1 at the free end of the rod 8 to a diameter D2 at the free end of the convergent body 10. The ratio D1/D2 may be comprised between 3 and 4 for example.

The applicator body 11 extends the second end of the convergent body 10 (along the longitudinal axis of the rod 8 in the example shown), for a second length L2 from the second end of the convergent body 10 to a distal end.

The applicator body 11 advantageously has a uniform cross-section from the second end of the convergent body 10 to the distal end of said applicator body. The applicator head may possibly further comprise a terminal tail (not shown) extending from the applicator body 11, possibly with a non-uniform cross-section (for example converging from the distal end of the applicator body 11 to the free end of the terminal tail).

The second length L2 is greater than the first length L1. Advantageously, the second length L2 may be greater than 1.2 times the first length L1. The second length L2 may be less than 2.4 times the first length L1. The first length L1 may be comprised for example between 2 and 8 mm, in particular about 5 mm.

The applicator body 11 may have a width D2 comprised between 0.5 mm and 5 mm, advantageously between 0.5 mm and 1 mm.

Said applicator body 11 may have any desired cross-section. In particular, the applicator body 11 may have a substantially circular cross-section having a diameter D2 comprised between 0.5 mm and 5 mm, advantageously between 0.5 mm and 1 mm. The cross-section of the applicator body 11 may be other than circular, for example square, rectangular, triangular, etc., and the applicator body 11 may possibly further comprise ribs. In general, the cross-section of the applicator body 11 may have a circumscribed diameter D2 (diameter of the smallest circle containing the cross-section) comprised between 0.5 mm and 5 mm, advantageously between 0.5 mm and 1 mm.

The applicator head 9 may be made of a flexible thermoplastic elastomer material, possibly flocked.

In particular, the applicator head 9 may be made of a flexible thermoplastic material such as polyethylene, polypropylene, corn polyamide, or an elastomer-type thermoplastic material such as thermoplastic polyurethane (TPU), silicone, EPDM (ethylene propylene diene monomer), styrene-butadiene (SBR), thermoplastic copolyester, etc.

The applicator head 9 may possibly be covered with fibers (flocking for example) and/or have a non-smooth surface (for example a granular surface or one scored with patterns) to facilitate the flow of the cosmetic product by capillary action.

The invention claimed is:

1. An applicator device for a cosmetic product, comprising a support suitable for being held in a user's hand and an applicator head carried by the support, the applicator head being flexible and suitable for applying the cosmetic product onto part of the body of a user, said applicator head comprising a convergent body and an applicator body, the convergent body extending for a first length while converging from a first end fixed to the support to a second end, and the applicator body extending the second end of the convergent body for a second length extending from the second end of the convergent body to a distal end, the applicator body having a uniform cross-section from the second end of the convergent body to the distal end of said applicator body, and the second length being greater than the first length, wherein said cross-section of the applicator body is selected from the group consisting of substantially circular, square and triangular cross-sections, and wherein the cross-section of the applicator body has a circumscribed diameter comprised between 0.5 mm and 5 mm.

2. The applicator device according to claim 1, wherein the second length is greater than 1.2 times the first length.

3. The applicator device according to claim 1, wherein the second length is less than 2.4 times the first length.

4. The applicator device according to claim 1, wherein the first length is comprised between 2 and 8 mm.

5. The applicator device according to claim 1, wherein the applicator head is made of a thermoplastic elastomer material.

6. The applicator device according to claim 1, further comprising a reservoir containing a liquid cosmetic product, the support having a rod suitable for insertion into said reservoir in order to dip said applicator head into the cosmetic product.

7. The applicator device according to claim 6, wherein the reservoir contains an eyeliner, constituting said liquid cosmetic product.

8. The applicator device according to claim 1, wherein the first length is about 5 mm.

9. The applicator device according to claim 1, wherein the cross-section of the applicator body has a circumscribed diameter comprised between 0.5 mm and 1 mm.

10. A method for applying a cosmetic product comprising the step of using an applicator device for a cosmetic product, said applicator device comprising a support suitable for being held in a user's hand and an applicator head carried by the support, the applicator head being flexible and suitable for applying the cosmetic product onto part of the body of a user, said applicator head comprising a convergent body and an applicator body, the convergent body extending for a first length while converging from a first end fixed to the support to a second end, and the applicator body extending the second end of the convergent body for a second length extending from the second end of the convergent body to a distal end, the applicator body having a uniform cross-section from the second end of the convergent body to the distal end of said applicator body, and the second length being greater than the first length, wherein said cross-section is selected from the group consisting of substantially circular, square and triangular cross-sections, and wherein the cross-section of the applicator body has a circumscribed diameter comprised between 0.5 mm and 5 mm.

11. The method for applying a cosmetic product according to claim 10 wherein said cosmetic product is an eyeliner.

* * * * *